US006688392B2

(12) United States Patent
Shaw

(10) Patent No.: US 6,688,392 B2
(45) Date of Patent: Feb. 10, 2004

(54) SYSTEM AND METHOD FOR FLOW/ PRESSURE BOOSTING IN A SUBSEA ENVIRONMENT

(75) Inventor: Christopher Kempson Shaw, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/154,099

(22) Filed: May 23, 2002

(65) Prior Publication Data

US 2003/0217848 A1 Nov. 27, 2003

(51) Int. Cl.[7] ..... E21B 29/12
(52) U.S. Cl. ..... 166/366; 357/105; 357/335
(58) Field of Search ..... 166/357, 365, 166/335, 370, 105, 366

(56) References Cited

U.S. PATENT DOCUMENTS

| | | | | | |
|---|---|---|---|---|---|
| 4,140,179 | A | * | 2/1979 | Kasevich et al. | 166/248 |
| 4,457,365 | A | * | 7/1984 | Kasevich et al. | 166/60 |
| 4,848,475 | A | * | 7/1989 | Dean et al. | 166/357 |
| 4,900,433 | A | | 2/1990 | Dean et al. | 210/170 |
| 4,982,794 | A | * | 1/1991 | Houot | 166/357 |
| 5,280,766 | A | | 1/1994 | Mohn | 166/368 |
| 5,460,227 | A | * | 10/1995 | Sidrim | 166/357 |
| 5,474,601 | A | | 12/1995 | Choi | 96/182 |
| 5,570,744 | A | * | 11/1996 | Weingarten et al. | 166/357 |
| 5,698,014 | A | * | 12/1997 | Cadle et al. | 96/157 |
| 5,765,964 | A | * | 6/1998 | Calcote et al. | 405/128.55 |
| 6,062,313 | A | * | 5/2000 | Moore | 166/357 |
| 6,192,988 | B1 | | 2/2001 | Tubel | |
| 6,230,810 | B1 | | 5/2001 | Rivas | 166/357 |
| 6,299,672 | B1 | | 10/2001 | Rivas | 95/243 |

FOREIGN PATENT DOCUMENTS

WO WO 02/36936 5/2002

OTHER PUBLICATIONS

Assayag et al., "Subsea Boosting Systems: Advances, Trends and Challenges", World Oil, Gulf Publishing Co., vol. 218, No. 11, XP000729322, Nov. 1997, pp. 61–62, 64, 66, 69.

* cited by examiner

*Primary Examiner*—Thomas B. Will
*Assistant Examiner*—Thomas A. Beach
(74) *Attorney, Agent, or Firm*—Madan, Mossman & Sriram, P.C.

(57) ABSTRACT

A system for producing hydrocarbon fluids from a subsea formation includes at least one producing well penetrating the formation for producing hydrocarbon fluids. At least one dummy well is hydraulically connected to the at least one producing well for routing the hydrocarbon fluids from the producing well to the dummy well. At least one pump is disposed in the at least one dummy well. The pump takes suction flow from the dummy well and boosts the flow energy of the discharge flow of hydrocarbon fluids.

41 Claims, 3 Drawing Sheets

SYSTEM AND METHOD FOR FLOW/PRESSURE BOOSTING IN A SUBSEA ENVIRONMENT

BACKGROUND OF THE INVENTION

1. Field of the Invention

The present invention relates to subsea production of hydrocarbons. More specifically, the invention relates to a system and method to provide flow/pressure boosting in a subsea environment.

2. Description of the Related Art

Petroleum development and production must be sufficiently profitable over the long term to withstand a variety of economic uncertainties. Booster pumping is increasingly being used to aid in the production of wellhead fluids. Subsea installations of these pumps are particularly helpful in producing remote fields and many companies are considering their use for producing remote pockets of oil and for producing deep water reservoirs from remote facilities located in shallower water. Such booster pumps allow producers to transport multiphase fluids (oil, water, and gas) from the wellheads to remote processing facilities (instead of building new processing facilities near the wellheads and often in deep water). These booster pumps also allow fluid recovery at lower final reservoir pressures before abandoning production. Consequently, there is a greater total recovery from the reservoir.

For deep water reservoirs, booster pumps are used to transport wellhead fluids from deep water wellheads to remote processing facilities located in shallower water. While there are a number of technical difficulties in this type of production, the cost savings are very large. Consequently, producers would like to transport wellhead fluids from the seafloor in deep waters through pipelines to remote processing facilities in moderate water depths. Transport distances of tens of kilometers are not uncommon with longer distances currently in the planning stages.

Commonly available booster pumping systems commonly include a submersible pump installed in the producing well or a pumping system connected to a subsea Christmas tree manifold attached to the wellheads from which fluids flow as a result of indigenous reservoir energy. The other end of the pumps are connected to a pipeline which transports the fluids from the wellhead to the remote processing site. Submersible pumps and their operation, including their installation, are well known and understood in the art. A problem, however, is that should a failure occur, valuable production flow can be interrupted while the pump is repaired. Subsea pumping systems connected externally to the producing well are typically unique to each application and require modifications and adaptations of surface pumps to the subsea environment. Such systems are typically more expensive and more difficult to install than submersible pumps.

Wellhead fluids can exhibit a wide range of chemical and physical properties. These wellhead fluid properties can differ from zone to zone within a given field and can change with time over the course of the life of a well. Furthermore, well bore flow exhibits a well-known array of flow regimes, including slug flow, bubble flow, stratified flow, and annular mist, depending on flow velocity, geometry, and the aforementioned fluid properties. Consequently, the ideal pumping system should allow for a broad range of input and output parameters without unduly compromising pumping efficiency and service life. Submersible pumps typically operate at conditions of lower gas fractions than seafloor mounted systems and thus exhibit fewer problems from such multiphase flows.

The methods and apparatus of the present invention overcome the foregoing disadvantages of the prior art by providing a submersible pump system that provides flow/pressure boosting and does not jeapordize production flow during downtime.

SUMMARY OF THE INVENTION

The present invention contemplates a subsea pumping system for boosting the flow energy of a production flow.

In one aspect, the present invention is a system for producing hydrocarbon fluids from a subsea formation, comprising at least one producing well penetrating the formation for producing hydrocarbon fluids. At least one dummy well is hydraulically connected to the at least one producing well for routing the hydrocarbon fluids from the producing well to the dummy well. At least one pump is disposed in the at least one dummy well. The pump takes suction flow from the dummy well and boosts the flow energy of the discharge flow of hydrocarbon fluids.

In another aspect, the present invention describes a method for producing hydrocarbon fluids from a subsea formation, comprising installing at least one pump in at least one dummy well where the dummy well is hydraulically connected to at least one producing well. The at least one dummy well acts as a suction reservoir for the pump. Production flow is routed from the producing well to the dummy well where the pump is used for imparting flow energy to the production flow.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

Figure 1:
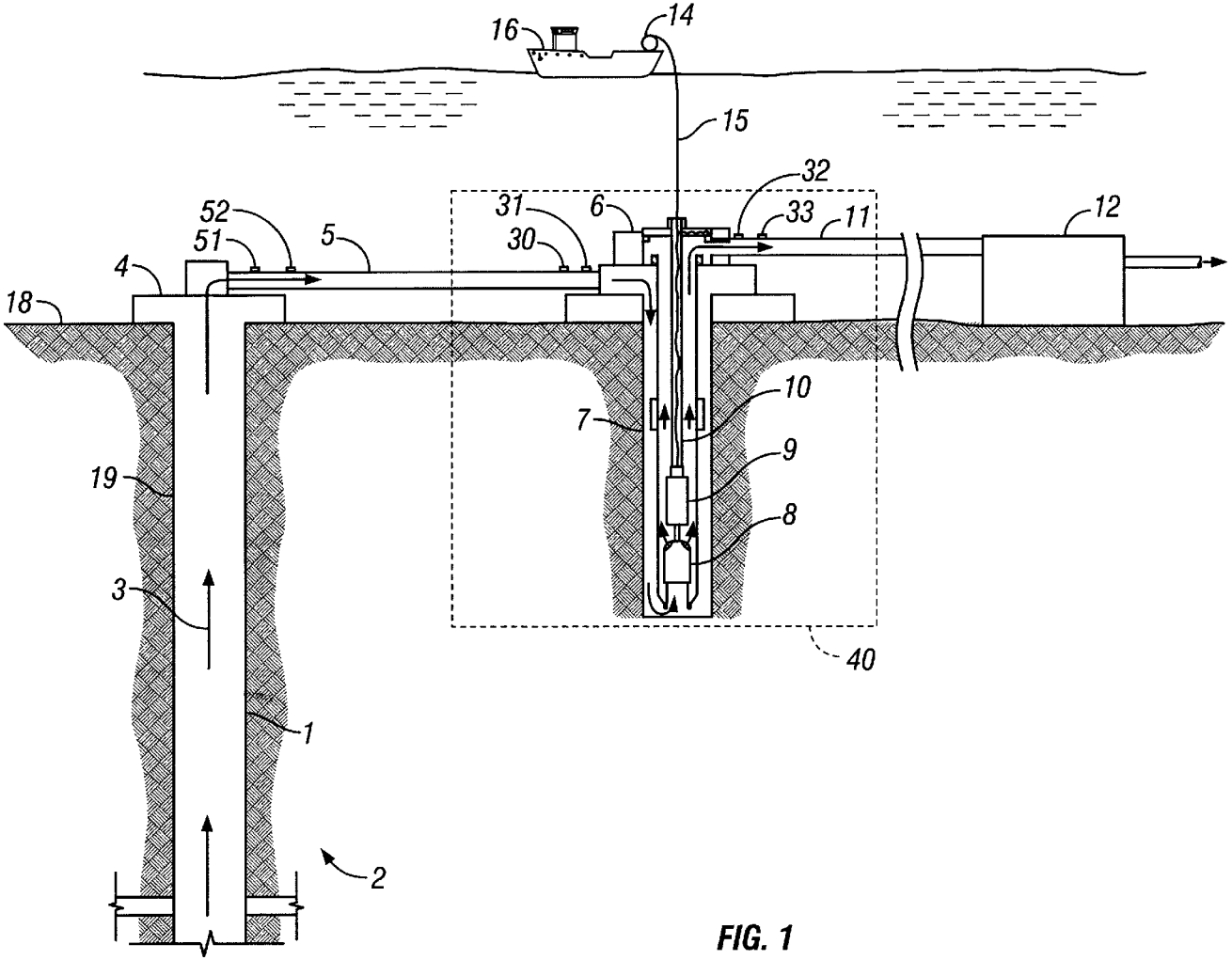
FIG. 1 is a schematic drawing of a subsea flow system according to one preferred embodiment of the present invention.

FIG. 1 shows a production system according to one embodiment of the present invention. Producing well 1 is shown penetrating a hydrocarbon bearing formation 2 at some depth below the seafloor 18. Well 1 is completed using any of the myriad of common techniques known in the art. Well 1 may be a vertical well as shown or, alternatively, may be highly inclined including horizontal. Formation fluid 3 flows up the wellbore 19 to a wellhead 4. The fluid 3 may be single phase or multiphase. Multiphase as used herein means (i) oil, water, and gas; (ii) oil and water; (iii) oil and gas; and (iv) water and gas. Well 1 is located at some distance from subsea processing station 12 where the distance may be on the order of tens of kilometers. As previously indicated, in many such cases, the pressure of the formation driving the flow of fluid, such as fluid 3, is insufficient to force adequate flow to reach processing station 12. Booster pumping system 40 is installed to provide sufficient flow energy to force adequate flow to reach the processing station 12.

Booster pumping system 40 (see FIG. 1 and FIG. 2), in one preferred embodiment, comprises a dummy well 7 extending to a predetermined depth below the seafloor 18. Dummy well 7 is drilled and cased with casing 44 using techniques known in the art. Dummy well 7 may be drilled and cased at the time that producing well 1 is drilled using the same rig (not shown) used to drill well 1. Alternatively, dummy well 7 may be drilled at any time using coiled tubing supported by a surface vessel equipped with coiled tubing equipment and using techniques known in the art. Wellhead 6 is attached to the top of dummy well 7 and flow conduit 5 connects producing wellhead 4 to dummy wellhead 6. Conduit 5 enables flow of fluid 3 from producing well 1 to dummy well 7. Liner 10 is hung off from wellhead 6 and extends to near the bottom of dummy well 7. A pump string 60 comprising submersible pump 8, motor 9, and tubing 17 is run into liner 10 on tubing 17 and hung off from wellhead cap 41. Tubing 17 may be a length of coiled tubing. Alternatively, tubing 17 may be lengths of threaded tubing joined together. In a preferred embodiment, electrical conductors 43 are run inside tubing 17 and connect motor 9 to power source 21 through a wet-mateable connector 49. Such connectors are known in the art and are not described here. Alternatively, electrical conductors 43 may be attached to the outside of tubing 17 using techniques known in the art.

The inlet to pump 8 is sealed to the liner 10 by seal 42 directing fluid 3 in the annulus 45 between casing 44 and liner 10 to enter pump 8. Well 7 depth is selected to provide sufficient suction pressure to allow pump 8 to operate at a desired efficiency. For example, for cases where a substantial portion of fluid 3 is liquid, the dummy well 7 may be just deep enough to fit a submersible pump string, on the order of 100 to 200 feet. In cases where there is a substantial gas fraction in fluid 3, the depth of dummy well 7 may be significantly deeper, on the order of 1000 feet. The increased depth reduces the gas-oil ration (GOR) due to increased pressure, and may also act to drive the gas back into solution in the liquid, both such conditions resulting in significantly increased pump efficiency. Such determinations are specific to each application. For cases where there is substantial gas entrained in the flow, vanes 47 may be attached to the outside of liner 10 to break up any large bubbles and mix the gas in the liquid phase as the flow passes the vanes 47. Vanes 47 may be spirally attached to the liner 10.

Flow 50 exits pump 8 with increased flow energy as compared to the inlet flow 3. Flow 50 travels up in annulus 46 and exits through pipeline 11 and travels to subsea processing station 12 (see FIG. 1) for further processing and distribution. Sensors 50,51,30,31,32, and 33 may be placed in the flow lines at multiple locations to characterize the flow conditions. Such sensors may be adapted to measure parameters of interest including, but not limited to (i) wellhead pressure at the producing well; (ii) hydrocarbon flow rate at the producing well; (iii) gas fraction at the wellhead; (iv) pressure in the dummy well; (v) pump discharge pressure; and (vi) pump discharge flow rate. Additional sensors may be connected to motor 9 for performance monitoring.

Figure 2:
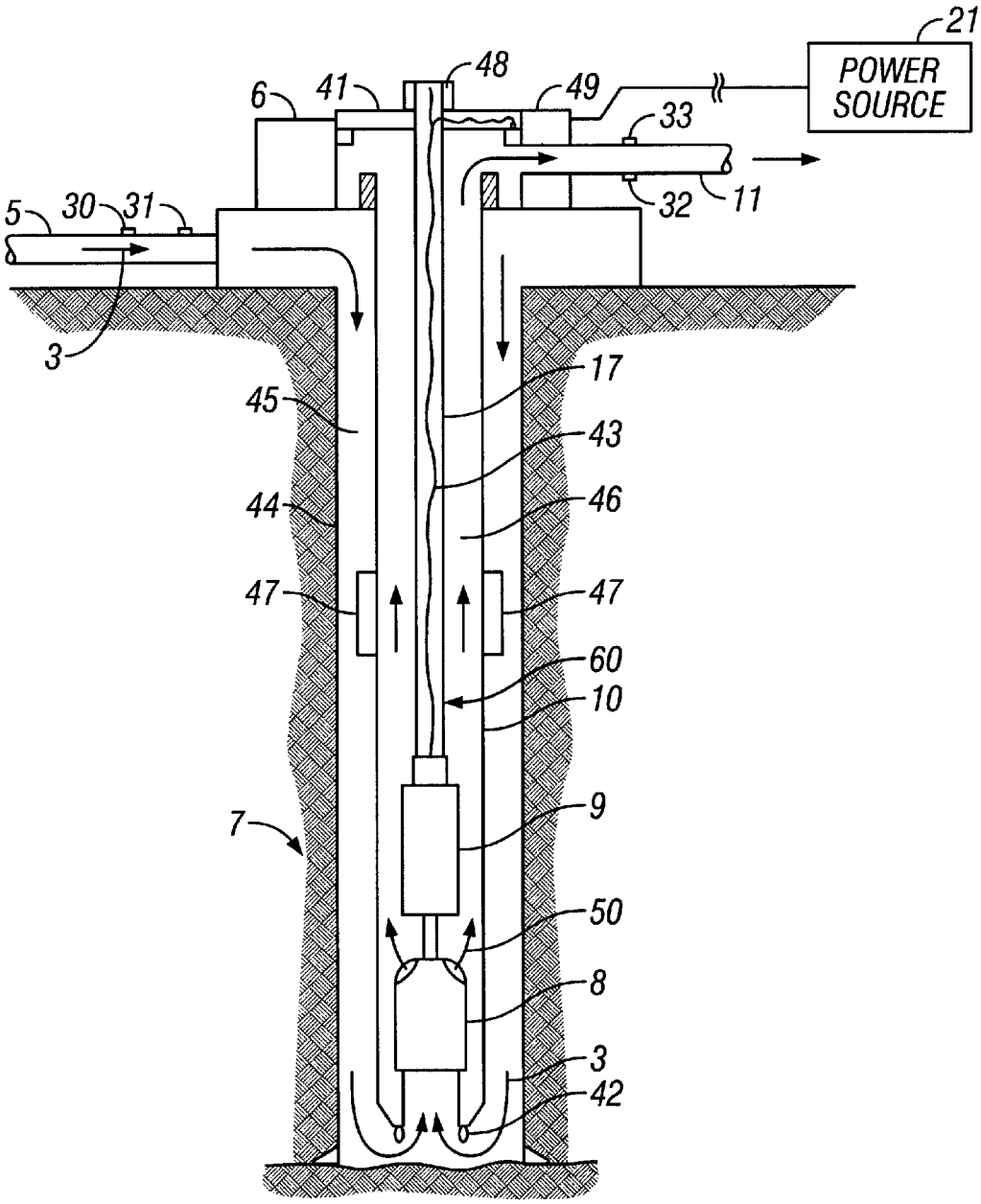
FIG. 2 is a schematic drawing of a booster pumping system according to one preferred embodiment of the present invention.

As shown in FIG. 1 and FIG. 2, the submersible pump 8 and motor 9 are insertable and extractable using a coiled tubing reel 14 and coiled tubing 15 operated from a surface vessel 16 which may be a light intervention type vessel of a type known in the art.

Figure 3:
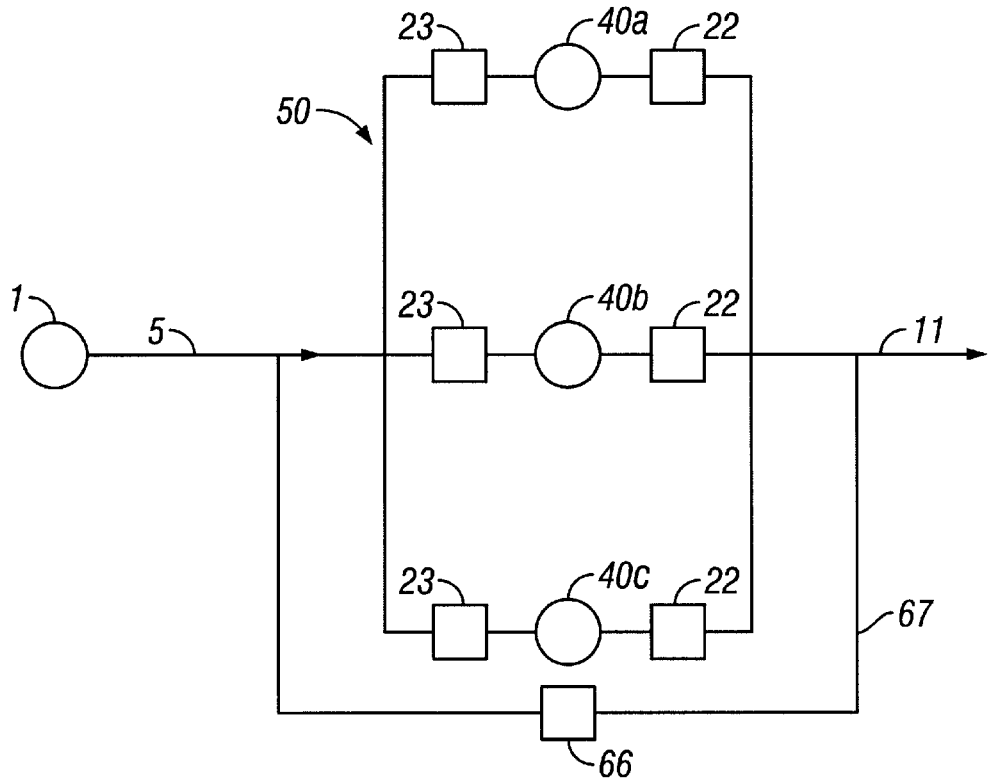
FIG. 3 is a flow diagram according to one preferred embodiment of the present invention.

In one preferred embodiment, shown in FIG. 3, three booster pumping systems 40*a–c* are connected with producing well 1 through manifold system 50. Manifold system 50 comprises valves 22 and 23 for directing flow from producing well 1 to any combination of booster pumping systems 40*a–c*. Typically each booster pumping system will be sized such that two of pumping systems 40*a–c* are always used, thereby providing a spare pump for high reliability. It should also be noted that multiple pumps may be installed in a pump string to increase reliability and/or flow output.

In operation, for example, if one of pumps 40*a–c* fails, the failed pump system may be isolated using the appropriate valves 22 and 23. Coiled tubing 15 is lowered from vessel 16. A suitable connector (not shown) on coiled tubing 15 is attaches to connector 48 on cap 41 and extracts pump string 60 from dummy well 7. The pump string 60 is repaired or replaced and reinserted back in dummy well 7 and put back in service as needed.

A subsea controller 65 (see FIG. 2) controls the pumping systems 40*a–c*. The controller may contain circuits for interfacing with various sensors and controlling the motor 9 and the valves 23 and 22 according to sensor data and programmed instructions. The subsea controller also contains communication circuits and communicates with other subsea systems such as processing station 12 and/or surface controllers (not shown).

Figure 4:
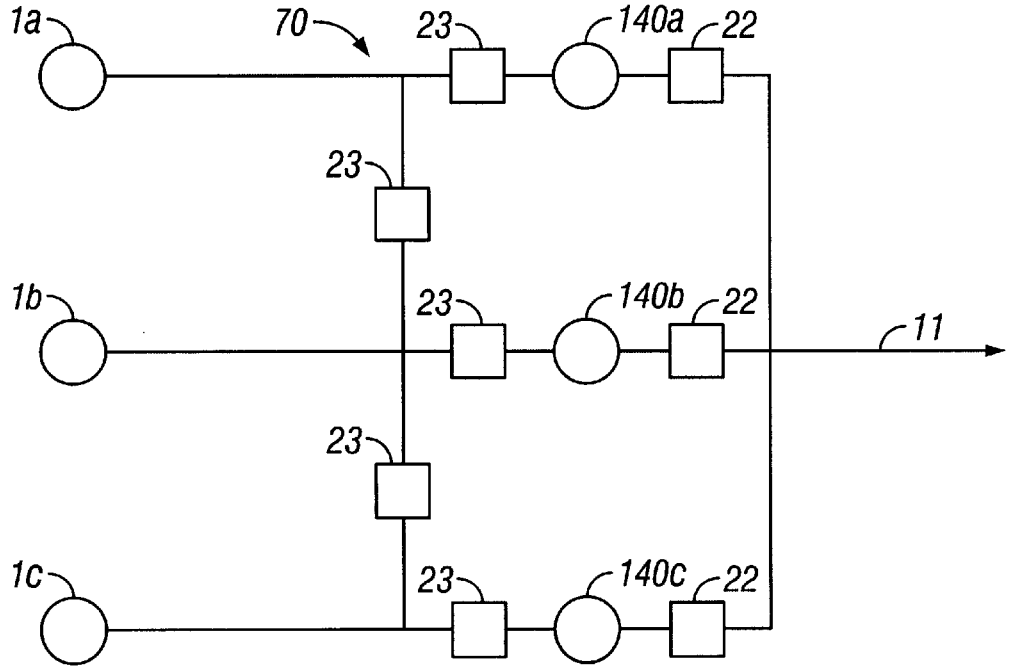
FIG. 4 is a flow diagram according to another preferred embodiment of the present invention.

In another preferred embodiment, see FIG. 4, three producing wells 1*a–c* are connected to flow control manifold 70. Manifold 70 directs the flow to pumping systems 140*a–c* as required. While three producing wells 1*a*–1*c* are shown, any number of producing wells may be connected to such a booster pumping system. In any such system, the pumps will be sized for the appropriate flows.

In all of the previously disclosed booster pump systems, a flow bypass system such as bypass 67 (see FIG. 3) may be incorporated to bypass the booster pump and allow natural (unboosted) production flow should such a need arise, for example with a failure of pump power. Such a bypass may have a remotely operated valve 66 for enabling such a bypass flow.

A system has been disclosed wherein a number of industry proven devices and techniques are combined in a novel arrangement to provide pressure/flow boosting to a production flow in a subsea environment. A dummy well is used to act as a suction reservoir for a submersible pump disposed in the dummy well. The dummy well has a case dependent depth to provide increased suction pressure resulting in improved pump efficiency, especially for flows with high gas content. The submersible pump is insertable and retrievable from a surface vessel using coiled tubing techniques. Multiple pumps may be inserted in one dummy well. In addition, multiple dummy wells with pumps may be manifolded to one or more producing wells.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. A system for producing hydrocarbon fluids from a subsea formation, comprising:

at least one producing well penetrating said formation for producing hydrocarbon fluids;

at least one dummy well hydraulically connected to said at least one producing well;

at least one pump disposed in said at least one dummy well, said at least one pump taking suction flow from said at least one dummy well and imparting flow energy to a discharge flow of said hydrocarbon fluids; and a manifold system for routing flow to the at least one dummy well.

2. The system of claim 1 further comprising a controller for controlling said flow of hydrocarbon fluids from said at least one pump.

3. The system of claim 1 wherein the at least one dummy well is a cased well.

4. The system of claim 1 further comprising a wellhead adapted to support said at least one pump in said at least one dummy well.

5. The system of claim 4 further comprising a liner extending from said wellhead to a position near a bottom of said at least one dummy well, said liner surrounding and sealed to said at least one pump and channeling said discharge flow to said wellhead.

6. The system of claim 1 wherein said at least one pump is supported in said at least one dummy well by a section of coiled tubing.

7. The system of claim 1 wherein said at least one pump is driven by an electric motor.

8. The system of claim 1 wherein the at least one pump is retrievably insertable in said at least one dummy well from a surface vessel.

9. The system of claim 1 further comprising at least one sensor for detecting at least one parameter of interest for controlling said hydrocarbon flow.

10. The system of claim 9 wherein the at least one parameter of interest is selected from the group consisting of (i) wellhead pressure at the producing well; (ii) hydrocarbon flow rate at the producing well; (iii) gas fraction at the wellhead; (iv) pressure in the dummy well; (v) pump discharge pressure; and (vi) pump discharge flow rate.

11. The system of claim 2 wherein the controller is located at the at least one dummy well.

12. The system of claim 2 wherein the controller is located at a subsea location spaced apart from said at least one dummy well.

13. The system of claim 2 wherein the controller is located at a surface location.

14. The system of claim 1 wherein the flow of hydrocarbon fluid is a multiphase flow.

15. The system of claim 1 wherein the manifold system comprises a plurality of remotely controlled valves for routing said flow.

16. The system of claim 1 further comprising a remotely controlled bypass system for allowing the flow of hydrocarbon fluid to bypass said at least one dummy well.

17. The system of claim 1 wherein the at least one pump is a submersible pump.

18. A system for imparting flow energy to a flow of hydrocarbon fluids in a subsea environment, comprising;

at least one dummy well connected to a source of the flow of hydrocarbon fluids;

at least one pump disposed at a predetermined depth in said at least one dummy well, said at least one pump taking suction flow from said at least one dummy well and imparting flow energy to a discharge flow of said hydrocarbon fluids; and a manifold system for routing flow to the at least one pump.

19. The system of claim 18 further comprising a controller for controlling said flow of hydrocarbon fluids from said at least one pump.

20. The system of claim 18 wherein the at least one dummy well is a cased well.

21. The system of claim 18 further comprising a wellhead adapted to support said at least one pump in said at least one dummy well.

22. The system of claim 22 further comprising a liner extending from said wellhead to a position near a bottom of said dummy well, said liner surrounding and sealed to said at least one pump and channeling said discharge flow to said wellhead.

23. The system of claim 18 wherein said at least one pump is supported in said at least one dummy well by a section of coiled tubing.

24. The system of claim 18 wherein said at least one pump is driven by an electric motor.

25. The system of claim 18 wherein the at least one pump is retrievably insertable in said at least one dummy well from a surface vessel.

26. The system of claim 18 further comprising at least one sensor for detecting at least one parameter of interest for controlling said hydrocarbon flow.

27. The system of claim 26 wherein the at least one parameter of interest is at least one of (i) hydrocarbon flow rate; (ii) hydrocarbon flow gas fraction; (iii) pressure in the dummy well; (iv) pump discharge pressure; and (v) pump discharge flow rate.

28. The system of claim 18 wherein the controller is located at the at least one dummy well.

29. The system of claim 18 wherein the controller is located at a subsea location spaced apart from said at least one dummy well.

30. The system of claim 18 wherein the controller is located at a surface location.

31. The system of claim 18 wherein the hydrocarbon flow is a multiphase flow.

32. The system of claim 18 wherein the predetermined depth is selected to substantially maximize the efficiency of said at least one pump.

33. The system of claim 18 wherein the manifold system comprises a plurality of remotely controlled valves for routing said flow.

34. The system of claim 18 wherein the at least one pump is a submersible pump.

35. The system of claim 18 further comprising a remotely controlled bypass system for allowing the flow of hydrocarbon fluid to bypass said at least one dummy well.

36. A method for producing hydrocarbon fluids from a subsea formation, comprising;

installing at least one pump in at least one dummy well hydraulically connected to at least one producing well, said at least one dummy well acting as a suction reservoir for said at least one pump;

hydraulically routing said production flow from said at least one producing well through a manifold system to said at least one dummy well;

imparting flow energy to said production flow using said at least one pump.

37. The method of claim 36 wherein the at least one pump is a submersible pump.

38. The method of claim 36 wherein the at least one pump is retrievably insertable in said at least one dummy well by a surface vessel.

39. The method of claim 36, further comprising detecting at least one parameter of interest for controlling said production flow.

40. The method of claim 39 wherein the at least one parameter of interest is at least one of (i) wellhead pressure at the producing well; (ii) hydrocarbon flow rate at the producing well; (iii) gas fraction at the wellhead; (iv) pressure in the dummy well; (v) pump discharge pressure; and (vi) pump discharge flow rate.

41. The method of claim 39 further comprising controlling said production flow with a subsea controller.

* * * * *